US009250592B2

(12) United States Patent
Yamashina et al.

(10) Patent No.: US 9,250,592 B2
(45) Date of Patent: Feb. 2, 2016

(54) IMAGE FORMING APPARATUS HAVING A SMOOTHNESS DETECTOR

(71) Applicants: Ryota Yamashina, Kanagawa (JP); Keitaro Shoji, Kanagawa (JP); Shuji Hirai, Tokyo (JP); Takumi Waida, Kanagawa (JP); Terumichi Ochi, Kanagawa (JP)

(72) Inventors: Ryota Yamashina, Kanagawa (JP); Keitaro Shoji, Kanagawa (JP); Shuji Hirai, Tokyo (JP); Takumi Waida, Kanagawa (JP); Terumichi Ochi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/592,278

(22) Filed: Jan. 8, 2015

(65) Prior Publication Data

US 2015/0205241 A1 Jul. 23, 2015

(30) Foreign Application Priority Data

Jan. 21, 2014 (JP) ..... 2014-008496

(51) Int. Cl.
*G03G 15/20* (2006.01)
*G03G 15/00* (2006.01)

(52) U.S. Cl.
CPC ..... *G03G 15/5029* (2013.01); *G03G 15/2039* (2013.01)

(58) Field of Classification Search
CPC ..... G03G 15/5029; G03G 15/2039
USPC ..... 399/45, 69, 67
See application file for complete search history.

(56) References Cited

U.S. PATENT DOCUMENTS

2011/0229179 A1* 9/2011 Yoshida et al. ..... 399/67
2014/0270822 A1 9/2014 Yamashina et al.

FOREIGN PATENT DOCUMENTS

| | | |
|---|---|---|
| JP | 10-160687 | 6/1998 |
| JP | 2000-284548 | 10/2000 |
| JP | 2004-042370 | 2/2004 |
| JP | 2006-062842 | 3/2006 |
| JP | 2007-055814 | 3/2007 |

OTHER PUBLICATIONS

U.S. Appl. No. 14/470,096, filed Aug. 27, 2014.
U.S. Appl. No. 14/473,448, filed Aug. 29, 2014.
U.S. Appl. No. 14/512,657, filed Oct. 13, 2014.
U.S. Appl. No. 14/474,939, filed Sep. 2, 2014.

* cited by examiner

*Primary Examiner* — Sophia S Chen
(74) *Attorney, Agent, or Firm* — Oblon, McClelland, Maier & Neustadt, L.L.P.

(57) ABSTRACT

An image forming apparatus includes a storage to store recording media, a smoothness detector to detect smoothness of the recording media, a memory unit to store smoothness values detected by the smoothness detector, a transfer device to transfer a toner image onto the recording media, a fixing device to fix the toner image onto the recording media, a temperature controller to determine a target fixing temperature for a second and subsequent recording media based on a predicted value calculated from the smoothness values, and a processor to reset the smoothness values in response to detection of an external factor that causes the smoothness detector to provide a smoothness value out of a predetermined range of the predicted value during an image forming operation from when the processor receives a sheet-feeding permission signal of one of the recording media stored in the storage until the recording medium is ejected.

10 Claims, 7 Drawing Sheets

IMAGE FORMING APPARATUS HAVING A SMOOTHNESS DETECTOR

CROSS-REFERENCE TO RELATED APPLICATION

This patent application is based on and claims priority pursuant to 35 U.S.C. §119(a) to Japanese Patent Application No. 2014-008496, filed on Jan. 21, 2014, in the Japan Patent Office, the entire disclosure of which is hereby incorporated by reference herein.

BACKGROUND

1. Technical Field

Embodiments of the present invention generally relate to an image forming apparatus for forming an image on a recording medium.

2. Background Art

Various types of electrophotographic image forming apparatuses are known, including copiers, printers, facsimile machines, or multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium.

SUMMARY

In one embodiment of the present invention, an improved image forming apparatus is described that includes a first storage to store recording media, a smoothness detector to detect surface smoothness of the recording media, a memory unit operatively connected to the smoothness detector to store smoothness values detected by the smoothness detector, a transfer device to transfer a toner image onto a surface of each of the recording media, a fixing device disposed downstream from the transfer device to fix the toner image onto the surface of each of the recording media under heat and pressure, a temperature controller operatively connected to the fixing device to determine a target fixing temperature of the fixing device for a second and subsequent recording media based on a predicted value calculated from the smoothness values stored in the memory unit, and a processor to reset the smoothness values stored in the memory unit in response to detection of an external factor that causes the smoothness detector to provide a smoothness value out of a predetermined range of the predicted value during an image forming operation from when the processor receives a sheet-feeding permission signal of one of the recording media stored in the first storage until the recording medium is ejected.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
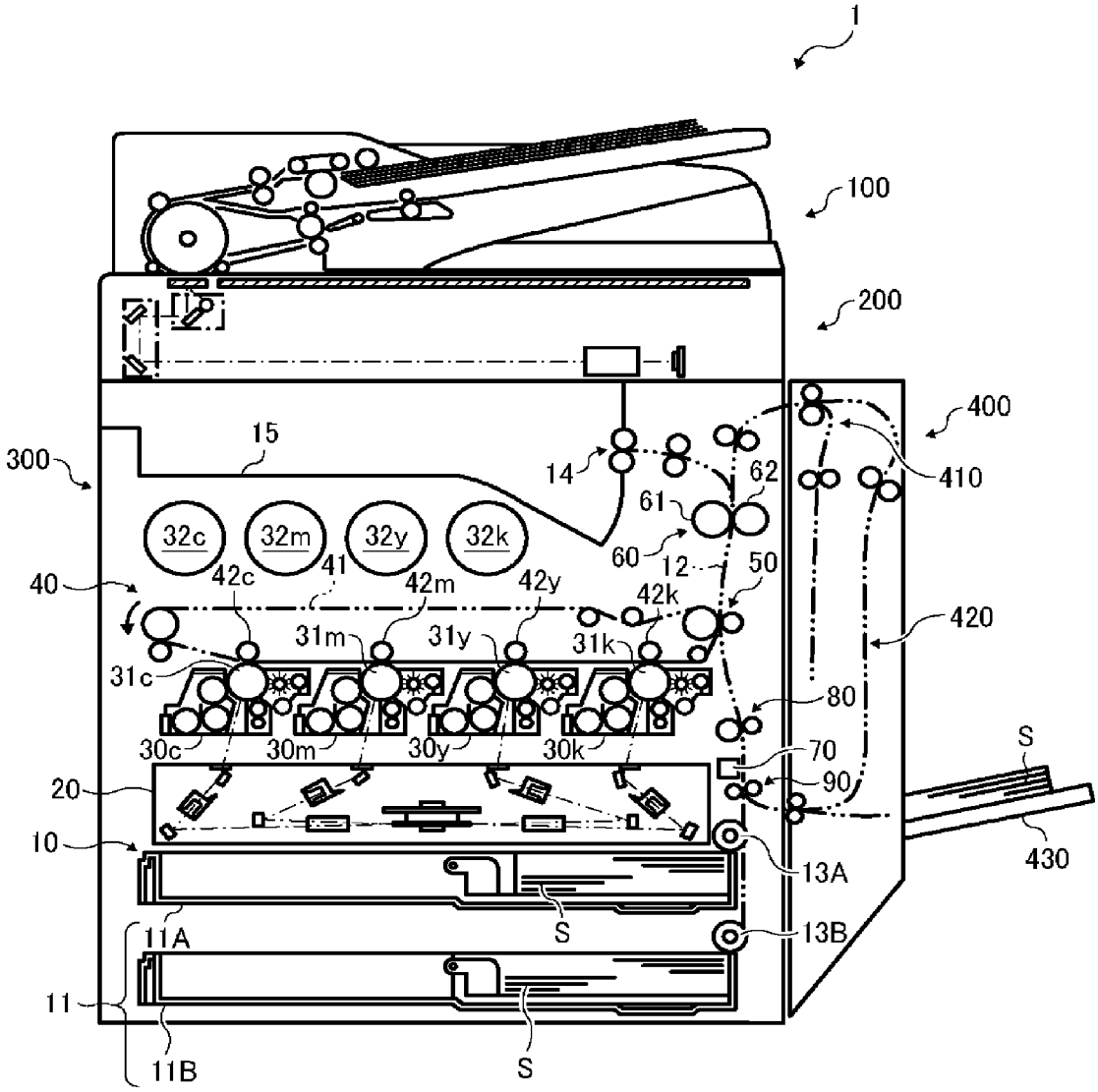
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and not all of the components or elements described in the embodiments of the present invention are indispensable.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

It is to be noted that, in the following description, suffixes "c", "m", "y", and "k" denote colors cyan, magenta, yellow, and black, respectively. To simplify the description, these suffixes are omitted unless necessary.

Referring now to the drawings, wherein like reference numerals designate identical or corresponding parts throughout the several views, embodiments of the present invention are described below.

Initially with reference to FIG. 1, a description is given of an image forming apparatus 1 according to an embodiment of the present invention. FIG. 1 is a schematic view of the image forming apparatus 1.

In the present embodiment, the image forming apparatus 1 is an electrophotographic image forming apparatus. As illustrated in FIG. 1, the image forming apparatus 1 includes, from the top, a document feeder 100, an image reading device 200, a body 300, and a duplex unit 400 disposed beside the body 300.

The document feeder 100, which is optional, is an auto document feeder (ADF) to automatically convey documents placed thereon one at a time starting from an uppermost document.

In addition, the document feeder 100 is hinged at the back to the image forming apparatus 1 and is openably closable with respect to the image reading device 200. It is to be noted that a document feeder having a known configuration can be used as the document feeder 100. Therefore, a detailed description thereof is herein omitted.

In the present embodiment, the image reading device 200 is a scanner, and reads an image of a document conveyed by the document feeder 100 or an image of a document placed on the image reading device 200. Image data of the document read by the image reading device 200 is outputted to the body 300. It is to be noted that an image reading device having a known configuration can be used as the image reading device 200. Therefore, a detailed description thereof is herein omitted.

The body 300 contains a sheet feeding unit 10, an exposure device 20, image formation devices 30*c*, 30*m*, 30*y*, and 30*k*, an intermediate transfer device 40, a secondary transfer device 50, and a fixing device 60. The image forming apparatus 1 performs a series of image forming processes with those devices in that order.

The sheet feeding unit 10 is disposed in a lower portion of the body 300, and includes a plurality of paper trays 11 serving as storages that can be withdrawn as needed. Specifically, in the present embodiment, the plurality of paper trays 11 are two paper trays 11A and 11B disposed one above the other. The paper trays 11A and 11B accommodate recording sheets S serving as recording media, and are provided with sheet feeding rollers 13A and 13B, respectively, that feed the recording sheets S from the respective paper trays 11A and 11B one at a time starting from an uppermost recording sheet S toward a conveyance passage 12. The sheet feeding rollers 13A and 13B are disposed above the paper trays 11A and 11B, respectively, at a position downstream in a sheet conveyance direction or media conveyance direction, that is, a direction in which the recording sheets S (recording media) are conveyed.

The exposure device 20 is disposed above the top paper tray 11A. The exposure device 20 irradiates the image formation devices 30*c*, 30*m*, 30*y*, and 30*k* with laser beams according to the image data provided by the image reading device 200, either of the document conveyed by the document feeder 100 or of the document placed on the image reading device 200, or according to image data received via a personal computer or a telephone line.

The image formation devices 30*c*, 30*m*, 30*y*, and 30*k* form cyan, magenta, yellow and black toner images, respectively. The image formation devices 30*c*, 30*m*, 30*y*, and 30*k* are arranged side by side as illustrated in FIG. 1. The image formation devices 30*c*, 30*m*, 30*y*, and 30*k* include drum-shaped image bearers 31*c*, 31*m*, 31*y*, and 31*k*, respectively, each of which is surrounded by various components such as a charging device, a developing device, a cleaning device, and a neutralizing device. While the image formation devices 30*c*, 30*m*, 30*y*, and 30*k* rotate in a clockwise direction in FIG. 1, imaging processes such as charging, developing, transfer (or primary transfer), cleaning, and neutralizing processes are performed in that order. The image formation devices 30*c*, 30*m*, 30*y*, and 30*k* are supplied with toner as developers of the respective colors from toner bottles 32*c*, 32*m*, 32*y*, and 32*k*, respectively.

The intermediate transfer device 40 includes an endless intermediate transfer belt 41 entrained around a plurality of rollers and stretched almost horizontally. The intermediate transfer belt 41 rotates in a counterclockwise direction in FIG. 1. The intermediate transfer device 40 also includes primary transfer devices 42*c*, 42*m*, 42*y*, and 42*k*. The primary transfer devices 42*c*, 42*m*, 42*y*, and 42*k* faces the image bearers 31*c*, 31*m*, 31*y*, and 31*k*, respectively, via the intermediate transfer belt 41 to transfer toner images formed on the image bearers 31*c*, 31*m*, 31*y*, and 31*k* onto the intermediate transfer belt 41, respectively. Thus, a primary transfer toner image is formed on the intermediate transfer belt 41.

The secondary transfer device 50 is disposed along the conveyance passage 12 and secondarily transfers the primary transfer toner image from the intermediate transfer belt 41 onto the recording sheet S.

The fixing device 60 includes a heating member 61 disposed to face a front surface of the recording sheet S and a pressing member 62 disposed to face a back surface of the recording sheet S and pressed against the heating member 61.

The fixing device 60 applies heat and pressure to the recording sheet S bearing the toner image that is secondarily transferred from the intermediate transfer belt 41 to fix the toner image onto the recording sheet S.

The body 300 further contains a paper ejection device 14 and a paper ejection tray 15. After the toner image is fixed onto the recording sheet S, the recording sheet S is conveyed from the fixing device 60 to the paper ejection device 14, which ejects the recording sheet S onto the paper ejection tray 15.

The duplex unit 400 is used to form an image on each side of the recording sheet S. The duplex unit 400 includes a switchback device 410 and a reverse device 420. The duplex unit 400 also includes a manual bypass tray 430 serving as a storage that supplies recording sheets S placed thereon to the body 300, apart from the paper trays 11.

Upon duplex printing, the recording sheet S having the image fixed on one side is conveyed to the duplex unit 400, in which the switchback device 410 switches an upstream end and a downstream end of the recording sheet S in the sheet conveyance direction, and conveys the recording sheet S to the reverse device 420. The reverse device 420 supplies the recording sheet S to the conveyance passage 12, specifically, to a position around an upstream end of the conveyance passage 12 in the sheet conveyance direction, via a passage through which recording sheets S are supplied from the bypass tray 430 to the body 300.

A sensor 70 is disposed along the conveyance passage 12, between the top sheet feeding roller 13A and the secondary transfer device 50. The sensor 70 detects certain physical characteristics of the recording sheet S from an upstream side in the sheet conveyance direction. Further, a registration device 80 is disposed along the conveyance passage 12, downstream from the sensor 70 in the sheet conveyance direction. The registration device 80 adjusts the timing of conveyance of the recording sheet S. Furthermore, a pair of conveyance rollers 90 is disposed along the conveyance passage 12, upstream from the sensor 70 in the sheet conveyance direction. The pair of conveyance rollers 90 conveys the recording sheet S.

The sensor 70 is a smoothness detector, disposed upstream from the registration device 80 in the sheet conveyance direction, used to detect the smoothness of the recording sheet S conveyed along the conveyance passage 12 from one of the paper trays 11 or the bypass tray 430. The smoothness of a plurality of recording sheets S detected by the sensor 70 is used as the smoothness of a recording sheet S used for setting fixing conditions such as a target fixing temperature.

Usually, in image forming apparatuses, fixing conditions such as a fixing temperature are taken into account to appropriately fix a toner image onto a recording medium. In particular, such fixing conditions are determined specifically for each type of recording medium to form a high-quality image on the recording media because the image quality is significantly influenced by such factors as the material, thickness, humidity, smoothness, and coating (if any) of the recording medium. The smoothness can be ascertained by the time (in seconds) it takes for a certain amount of air to flow between the surface of the recording medium and a testing board adhering to the surface of the recording medium. (It is to be noted that the term "coating" means coating or printing the recording medium with, e.g., ink or paint.)

The smoothness and fixability of recording media are correlated because the rougher the surface of the recording medium, in particular the fixing rate of toner in recessed portions of recording medium, the poorer the fixability of images on that medium. Accordingly, if an image is fixed onto the recording medium under fixing conditions neglecting the smoothness, a high-quality image may not be obtained and, in some cases, fixing errors may occur, generating an unacceptable image on the recording medium.

Meanwhile, as image forming apparatuses have become more sophisticated and modes of expression have become more diverse, there are now hundreds of different types of recording media (e.g., recording sheets). Each type of recording sheets has a variety of brands with, e.g., different basis weights and thicknesses. Therefore, to form a high-quality image, fixing conditions are determined in detail according to, e.g., the types and brands of recording media (e.g., recording sheets).

For example, types of recording media includes, e.g., plain paper, coated paper such as gloss coated paper, mat coated paper, and art paper, overhead projector (OHP) sheets, and special paper such as a sheet of paper prepared by embossing. Increasing numbers of such special paper have come into recent usage. It is to be noted that there exist recording media other than recording sheets.

In the image forming apparatuses, generally, the fixing conditions are determined according to the basis weight of the recording medium by which the recording medium is classified. For example, paper having a basis weight of about 60 $g/m^2$ to about 90 $g/m^2$ is classified as plain paper. Paper having a basis weight of about 91 $g/m^2$ to about 105 $g/m^2$ is classified as medium thick paper. Paper having a basis weight of about 106 $g/m^2$ to about 200 $g/m^2$ is classified as thick paper. The fixing temperature, the conveying speed of the recording medium, and the like are determined according to these classifications.

Generally, the basis weight of recording media is listed on the package so that the basis weight is easily ascertained.

If an image forming apparatus is a copier, a controller of the image forming apparatus acknowledges the basis weight inputted through an operation panel of the image forming apparatus. On the other hand, if the image forming apparatus is a printer, the controller of the image forming apparatus acknowledges the basis weight included in printing data through a printer driver displayed by a personal computer.

Thus, the basis weight is set manually through the operation panel or the personal computer, which may be troublesome to appropriately operate the image forming apparatus. In addition, if a wrong basis weight is set, an intended high-quality image may not be obtained. Accordingly, some image forming apparatuses typically incorporate a sensor to detect, e.g., the thickness of recording media to automatically sort the recording media to form images thereon.

On the other hand, the smoothness of recording media is not usually listed on the package, which makes it difficult to ascertain the smoothness. For this reason, a sensor may be used to obtain the smoothness of recording media.

As described above, the smoothness and the fixability are correlated. However, it is difficult to detect the smoothness in a short period of time because the smoothness is typically determined by the time it takes for a certain amount of air to flow between the surface of a recording medium and a testing board. Accordingly, sensors may be used to measure surface roughness or an amount of reflected light as alternative characteristics to the smoothness because such surface roughness or amount of reflected light and the smoothness are correlated.

For example, the smoothness of a recording medium is detected according to an amount of light reflected by a surface of the recording medium when the recording medium is irradiated with light emitted from a light source such as a light-emitting diode (LED). In this optical detecting system, the smoothness can be detected without contacting the recording medium, and therefore, without damaging the recording medium.

As another example of detecting the smoothness using the optical detecting system, the quality (smoothness) of a recording medium is detected using an amount of light reflected by the surface of the recording medium and an amount of light permeating through the recording medium.

Alternatively, the quality (smoothness) of a recording medium may be detected in image forming apparatuses that include a light emission source and two light receivers. Specifically, the light emission source irradiates the surface of the recording medium with light and the two light receivers receive regular reflection light and scattering reflection light from the surface of the recording medium. According to an amount of the regular reflection light and an amount of the scattering reflection light, the smoothness of the recording medium can be detected.

The smoothness detected in such ways as described above is used for determining, e.g., fixing conditions such as a fixing temperature and image forming conditions. In the meantime, it takes a certain amount of time from when an image forming process starts to when a toner image is transferred onto a recording medium, and to when an actual fixing temperature reaches a target fixing temperature.

Accordingly, the position of a smoothness sensor and detection timing are particularly important for image forming apparatuses that detect the smoothness in advance, taking into account the above-described certain amount of time (i.e., time lag), to use the detected smoothness of recording media for determining the fixing conditions and the image forming conditions.

Disposing the sensor 70 upstream from the registration device 80 obviates the need for providing a plurality of sensors 70 at the paper trays 11A and 11B and the bypass tray 430, respectively, and allows the single sensor 70 to calculate all the recording sheets S passing through the conveyance passage 12. Since the sensor 70 is disposed upstream from the registration device 80 in the sheet conveyance direction, the sensor 70 can detect the smoothness of the recording sheet S while the registration device 80 temporarily stops conveyance of the recording sheet S for registration. Accordingly, the sensor 70 can detect the smoothness of the recording sheet S more accurately than in a sheet feeding process, that is, while the recording sheet S is moving. A detailed description of the sensor 70 is deferred.

To provide a fuller understanding of embodiments of the present invention, a description is now given of an image forming operation, in this case photocopying, performed in the image forming apparatus 1.

Firstly, in the image forming apparatus 1, the charging devices uniformly charge the image bearers 31. Then, the exposure device 20 irradiates the charged image bearers 31 to form latent images thereon according to image data of the respective colors of a document read by the image reading device 200.

Thereafter, the developing devices develop the latent images formed on the image bearers 31 with toner of the respective colors into toner images.

Then, the primary transfer devices 42 primarily transfer the toner images from the image bearers 31 onto an outer circumferential surface of the intermediate transfer belt 41 sequentially to form a desired color toner image thereon.

In the meantime, one of the sheet feeding rollers 13A and 13B is selectively rotated to feed a recording sheet S from the corresponding one of the paper trays 11A and 11B to the conveyance passage 12. Alternatively, a recording sheet S is sent from the bypass tray 430 to the conveyance passage 12.

When receiving the recording sheet S conveyed along the conveyance passage 12, the registration device 80 temporarily stops conveyance of the recording sheet S. While the registration device 80 stops movement of the recording sheet S, the sensor 70 calculates the smoothness of the recording sheet S. The registration device 80 then sends the recording sheet S to a secondary transfer position between the intermediate transfer belt 41 and the secondary transfer device 50 in synchronization with the movement of the intermediate transfer belt 41 bearing the color toner image.

At the secondary transfer position, the secondary transfer device 50 transfers the color toner image from the intermediate transfer belt 41 to the recording sheet S.

The recording sheet S bearing the color toner image is then conveyed to the fixing device 60. The fixing device 60 fixes the color toner image onto the recording sheet S by applying heat and pressure to the recording sheet S between the heating member 61 and the pressing member 62.

Upon duplex printing, the recording sheet S having the color image fixed on the front surface is sent to the duplex unit 400 via a pawl that switches the conveyance passage.

In the duplex unit 400, as described above, the switchback device 410 switches the upstream end and the downstream end of the recording sheet S in the sheet conveyance direction, and conveys the recording sheet S to the reverse device 420. The reverse device 420 supplies the recording sheet S to the position around an upstream end of the conveyance passage 12 in the sheet conveyance direction, via the passage through which the recording sheets S are supplied from the bypass tray 430 to the body 300.

Thereafter, the secondary transfer device 50 secondarily transfers another color toner image from the intermediate transfer belt 41 onto the back surface of the recording sheet S conveyed along the conveyance passage 12 in the same manner as the other color toner image is transferred onto the front surface of the recording sheet S. Then, the recording sheet S is conveyed to the fixing device 60, which fixes the secondarily transferred color toner image onto the back surface of the recording sheet S.

After the color toner image(s) is/are completely fixed onto the recording sheet S, the paper ejection device 14 discharges the recording sheet S onto the paper ejection tray 15. Thus, a plurality of recording sheets S are loaded onto the paper ejection tray 15, and the image forming apparatus 1 completes the image forming operation.

Figure 2:
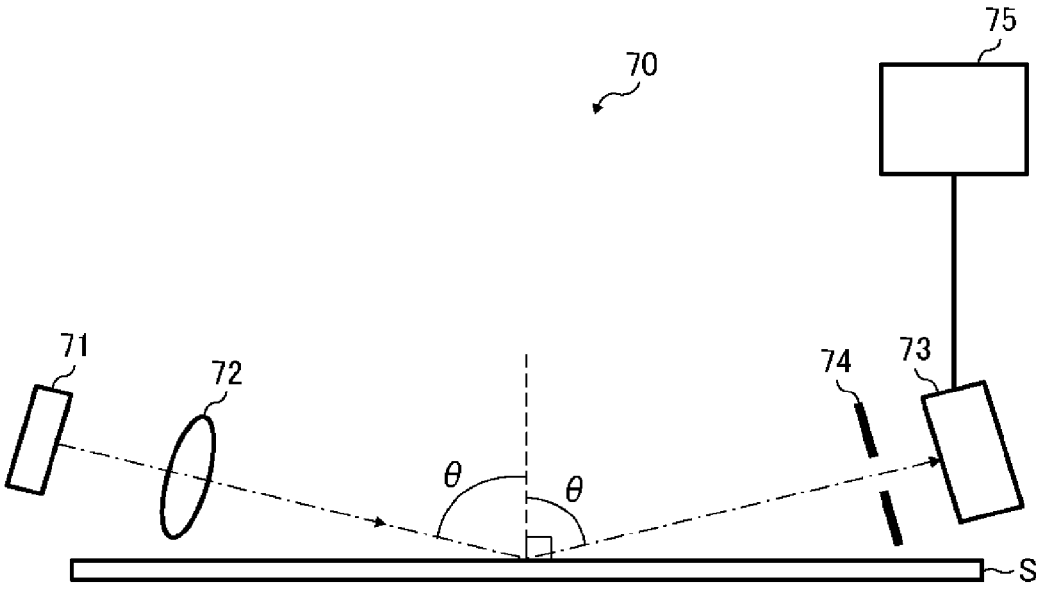
FIG. 2 is a schematic view of a sensor incorporated in the image forming apparatus.

Referring now to FIG. 2, a detailed description is given of the sensor 70 incorporated in the image forming apparatus 1 described above. FIG. 2 is a schematic view of the sensor 70.

The sensor 70 includes a light source 71, a collimator lens 72, a regular-reflection light sensor 73, an aperture 74, and a controller 75.

The light source 71 of the present embodiment is constructed of vertical cavity surface emitting lasers (VCSELs) to suppress a far-field pattern (FFP) more effectively than typical stable light sources such as light emitting diodes (LEDs) or edge-emitting laser diodes (LDs), thereby forming a more accurate optical system. Here, the FFP refers to the beam divergence of a laser beam. Alternatively, the light source 71 may be constructed of, e.g., LEDs.

The collimator lens 72 is an aspheric convex lens disposed between the light source 71 and an irradiated surface of the recording sheet S to turn laser beams emitted from the light source 71 into collimated laser beams. Specifically, the collimator lens 72 turns the laser beams emitted from the light source 71 into parallel laser beams that does not diffuse or converge.

In addition, the collimator lens 72 adjusts the parallelism of collimated laser beams and the incidence angle θ of the laser beams emitted from the light source 71. With the collimator lens 72, the sensor 70 can enhance its sensitivity of detecting the smoothness of the recording sheet S.

The regular-reflection light sensor 73 is disposed downstream from the irradiated surface (i.e., reflective surface) of the recording sheet S in an optical axis direction of the laser beams emitted from the light source 71. The regular-reflection light sensor 73 is constructed of, e.g., photodiodes to detect laser beams regularly reflected by the recording sheet S.

Specifically, the regular-reflection light sensor 73 detects the intensity of the laser beams regularly reflected by the recording sheet S as voltage, and outputs the detection result to the controller 75 as an output signal that the controller 75 can use to calculate the smoothness of the recording sheet S.

The aperture 74 is disposed between the irradiated surface of the recording sheet S and the regular-reflection light sensor 73 to limit the incidence angle of the laser beams entering the regular-reflection light sensor 73 after being reflected by the recording sheet S. With the aperture 74, the sensor 70 can ensure a sufficient intensity of the laser beams reflected by the reflective surface of the recording sheet S after being emitted from the light source 71, while limiting scattering among the reflected laser beams. Accordingly, the sensor can enhance smoothness detection accuracy.

The controller 75 is connected to the regular-reflection light sensor 73 and calculates the smoothness of the recording sheet S according to the detection data provided by the regular-reflection light sensor 73. A detailed description of the controller 75 is deferred.

Thus, the sensor 70 detects the intensity of regular reflection light, that is, the laser beams reflected by the recording sheet S in a regular reflection direction among the laser beams emitted from the light source 71 to the recording sheet S. Accordingly, the sensor 70 detects the surface smoothness of the recording sheet S. Thus, according to the present embodiment, the sensor 70 serves as a smoothness sensor.

Figure 3:
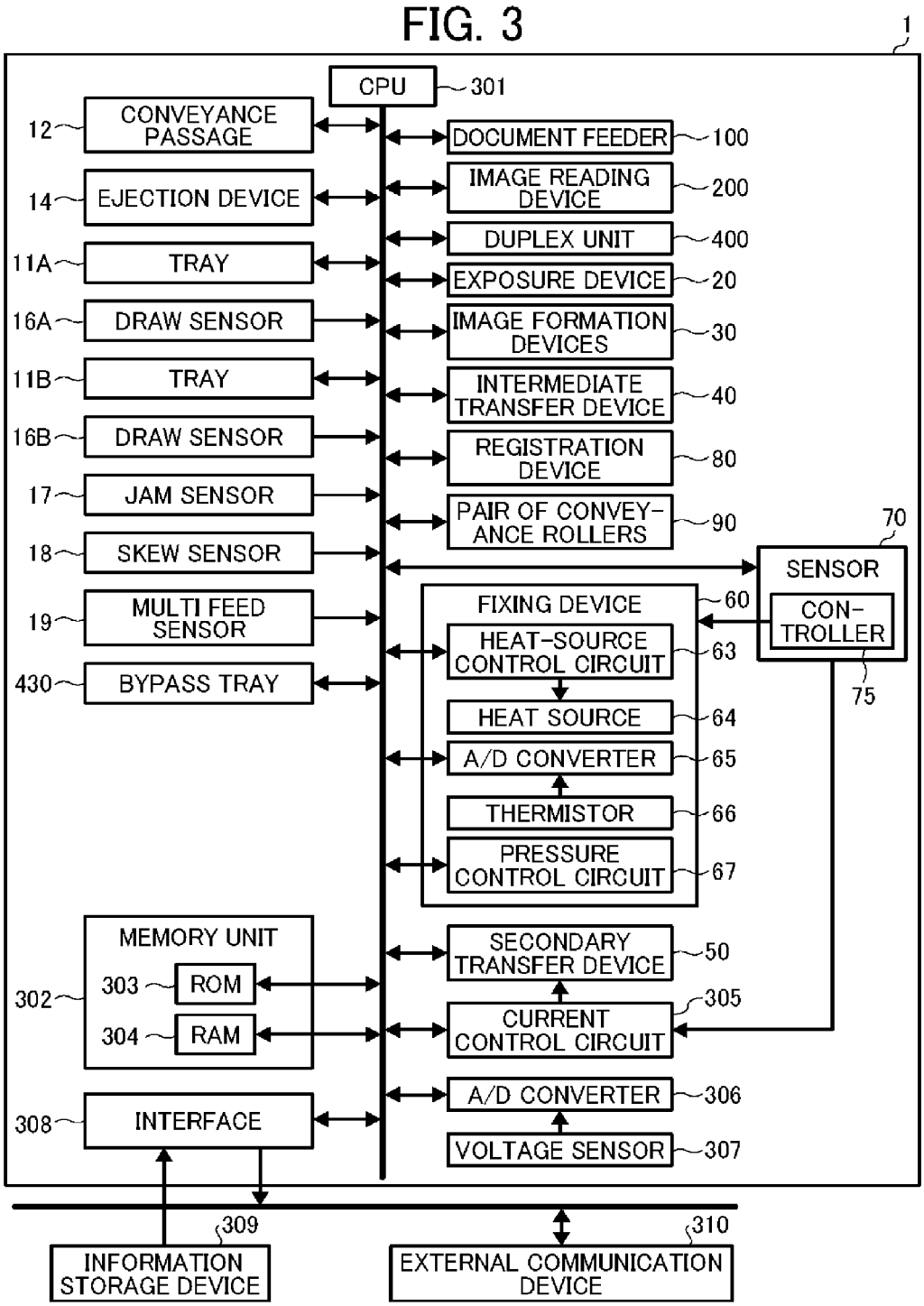
FIG. 3 is a functional block diagram of the image forming apparatus.

FIG. 3 is a functional block diagram of the image forming apparatus 1.

In FIG. 3, a central processing unit (CPU) 301 disposed in the body 300 is connected to other components of the image forming apparatus 1 via a bus to control the components so that the image forming apparatus 1 works properly.

Specifically, the CPU 301 is connected to the document feeder 100, the image reading device 200, and the duplex unit 400 to control their driving systems or control systems. The CPU 301 is also connected to the paper trays 11A and 11B, the conveyance passage 12, the paper ejection device 14, and the bypass tray 430 to control their driving systems (e.g., the sheet feeding rollers 13A and 13B of the paper trays 11A and 11B, respectively). Further, the CPU 301 is connected to the exposure device 20, image formation devices 30, the intermediate transfer device 40, the secondary transfer device 50, the fixing device 60, the sensor 70, the registration device 80, and the pair of conveyance rollers 90. Furthermore, the CPU 301 is connected to a memory unit 302, a current control circuit 305, an analog-to-digital (A/D) converter 306, a voltage sensor 307, and an interface 308.

It is to be noted that the CPU 301 receives an empty signal from an empty sensor that detects an empty state of the paper trays 11 and the bypass tray 430 when no recording sheets S are left there. The CPU 301 is also connected to draw sensors 16A and 16B to receive detection signals from the draw sensors 16A and 16B, which detect that the paper trays 11A and 11B are withdrawn from the body 300, respectively.

Accordingly, the CPU 301 detects changes in storage status of the recording sheets S when the empty sensor detects the empty state of the paper trays 11A, 11B and the bypass tray 430, or when the draw sensor 16A detects that the paper tray 11A is withdrawn from the body 300, and/or when the draw sensor 16B detects that the paper tray 11B is withdrawn from the body 300.

In addition, the CPU 301 is connected to a jam sensor 17, a skew sensor 18 and a multi feed sensor 19 to receive detection signals therefrom. The jam sensor 17 detects that the recording sheet S is jammed somewhere along the conveyance passage 12 from when the recording sheet S is fed to the conveyance passage 12 to when the recording sheet S is ejected onto the paper ejection tray 15. The skew sensor 18 detects that the recording sheet S is skewed and conveyed. The multi feed sensor 19 detects that two or more recording sheets S are conveyed one atop another.

In the present embodiment, the jam sensor 17, the skew sensor 18, and the multi feed sensor 19 are also used as detectors to detect an external factor that causes the sensor 70 to detect smoothness of the recording sheet S different from actual smoothness of the recording sheet S.

The fixing device 60 includes a heat-source control circuit 63 and a thermistor 66. The heat-source control circuit 63 determines an amount of heat that is supplied for a heat source 64 of the heating member 61 (hereinafter referred to as an amount of heat to supply). In other words, the heat-source control circuit 63 determines a target fixing temperature. The thermistor 66 detects the temperature of the heat source 64 of the heating member 61.

As described above, the target fixing temperature is determined taking into account the smoothness to acquire a high-quality image because the smoothness and the fixability are correlated. Accordingly, in the present embodiment, the controller 75 determines the target fixing temperature together with the heat-source control circuit 63 according to readings from the sensor 70, that is, the surface smoothness of the recording sheet S detected by the sensor 70.

The fixing device 60 also includes an A/D converter 65 that converts analog data from the thermistor 66 into digital data and sends the digitized data to the CPU 301 so that the CPU 301 can use it for processing. Further, the fixing device 60 includes a pressure control circuit 67 to control both a force for pressing the pressing member 62 against the heating member 61 and a distance between the heating member 61 and the pressing member 62.

The fixing device 60 is connected to the controller 75 of the sensor 70 to receive signals transmitted by the controller 75 so that the heat-source control circuit 63 and the pressure control circuit 67 are controlled. Thus, according to the present embodiment, the controller 75 serves as a temperature controller.

It is to be noted that the heat-source control circuit 63 and the pressure control circuit 67 may be used as detectors to detect an external factor that causes the sensor 70 to detect significantly changed smoothness when heating and pressure values of the heat-source control circuit 63 and the pressure control circuit 67 significantly change.

For example, when the type of recording sheets S placed on the paper trays 11A and/or 11B are changed, the heating value of the heat-source control circuit 63 or the pressure value of the pressure control circuit 67 may significantly change. In addition, execution of mixed loading mode with different sizes of documents may be an external factor that causes the sensor 70 to detect significantly changed smoothness, because the image forming process is performed on different sizes of recording sheets S placed on the paper trays 11A and 11B.

The memory unit 302 includes a read only memory (ROM) 303 and a random access memory (RAM) 304. The ROM 303 stores a fixing control pattern and a program code that the CPU 301 executes. The RAM 304 temporarily stores detected voltage.

The CPU 301 reads the program code from the ROM 303, loads the program code in the RAM 304, and executes a program defined by the program code using the RAM 304 as a data buffer to control the components of the image forming apparatus 1.

The current control circuit 305 receives a signal transmitted by the controller 75 of the sensor 70 to control a transfer current with which the secondary transfer device 50 transfers a toner image onto the recording sheet S.

It is to be noted that the current control circuit 305 may be used as a detector to detect an external factor in that the sensor 70 provides a range of different readings (smoothness detection results) when a predetermined secondary transfer current significantly changes.

For example, when the type of recording sheets S placed on the paper trays 11A and 11B is changed, the predetermined secondary transfer current may significantly change. In addition, execution of a mixed loading mode with different sizes of documents may be an external factor in that the sensor 70 provides a range of readings, because the image forming process is performed on different sizes of recording sheets S placed on the paper trays 11A and 11B.

The A/D converter 306 converts analog voltage data from the voltage sensor 307, which detects voltage so that control is executed in a stable power state, into digital data and sends the digitized data to the CPU 301 so that the CPU 301 can use it for processing.

The interface 308 serves as a connector to connect the image forming apparatus 1 with external devices such as an information storage device 309 and an external communication device 310 to accept external image data into the image forming apparatus 1. The information storage device 309 is, e.g., a hard disk drive and the external communication device 310 is, e.g., a personal computer.

Generally, to accurately detect the smoothness of a recording medium, the smoothness sensor and the recording medium are positioned to maintain a certain gap and angle therebetween appropriate for accurate detection of the smoothness.

Accordingly, if the gap and angle between the smoothness sensor and the recording medium are not maintained, the detected amount of reflected light decreases. As a result, even if the recording medium has a high smoothness (low surface roughness), the smoothness sensor may erroneously ascertain that the recording medium has a low smoothness (high surface roughness). In such a case, a relatively high target fixing temperature may be determined, generating unacceptable images and increasing power consumption.

According to the present embodiment, to set an appropriate target fixing temperature in the image forming apparatus 1, a representative smoothness (M) is identified from among a plurality of detected smoothnesses of a plurality of recording sheets S, and the target fixing temperature is adjusted according to the representative smoothness (M). Accordingly, the representative smoothness (M) is also a prediction regarding the smoothness of subsequent recording sheets S.

Figure 4:
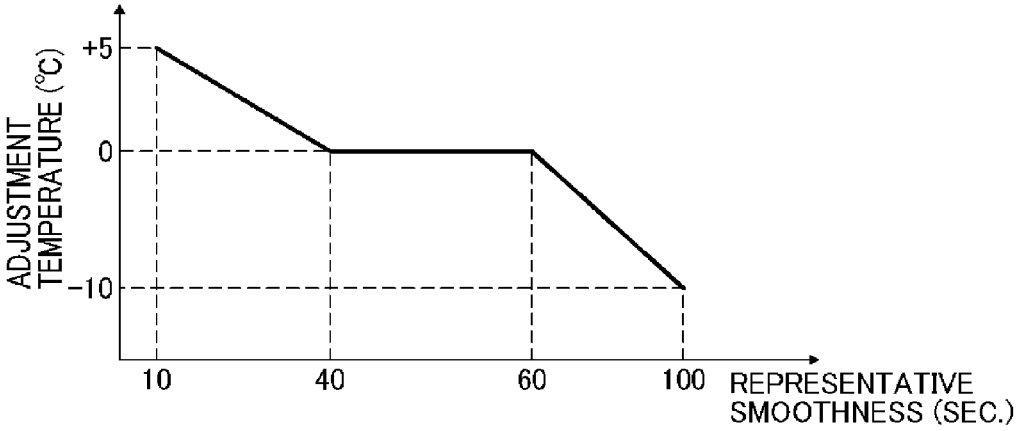
FIG. 4 is a graph illustrating a relationship between representative smoothness and adjustment temperature.

FIG. 4 is a graph illustrating a relationship between the representative smoothness (M) and adjustment temperature. As illustrated in FIG. 4, the representative smoothness (M) is used to determine an adjustment temperature based on an adjustment temperature table relative to predetermined representative smoothness (M). Practically, the target fixing temperature is a temperature adjusted by increasing or decreasing a current fixing temperature of the fixing device 60.

It is to be noted that readings stored in the memory unit 302 are reset to an initial value when the draw sensor 16A detects that the paper tray 11A is withdrawn from the body 300 and/or when the draw sensor 16B detects that the paper tray 11B is withdrawn from the body 300, and thus, changes in storage status of the recording sheets S are detected. In short, when the readings are reset, an adjusted value increased or decreased from the current fixing temperature is set substantially to zero.

Accordingly, to determine the target fixing temperature of the fixing device 60 in the present embodiment, the memory unit 302 accumulates sequentially an earlier smoothness reading of recording sheet S and later smoothness readings of recording sheets S from the sensor 70 so that an average smoothness (m) is calculated. The representative smoothness (M) is calculated using the average smoothness (m) and a standard deviation (σ) to identify a value increased or decreased from the current fixing temperature.

Figure 5:
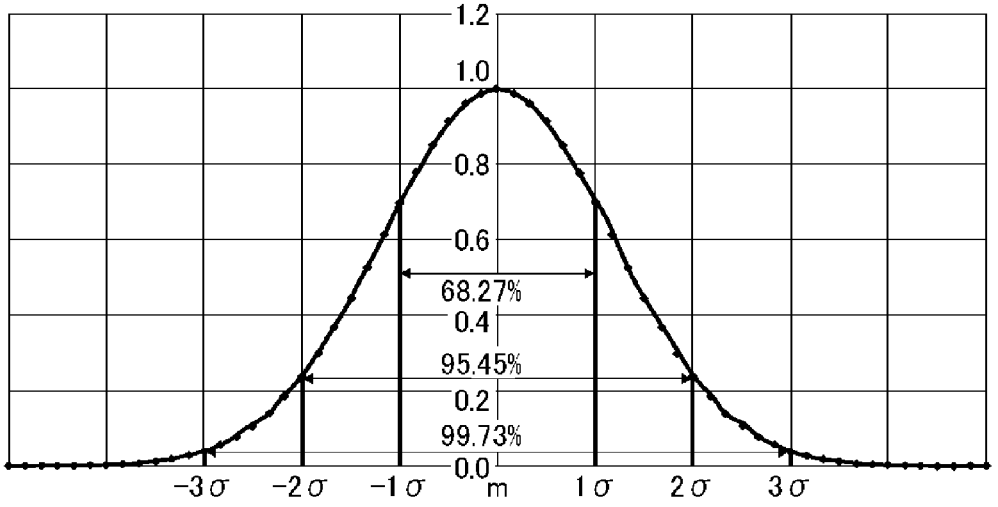
FIG. 5 is a graph illustrating an area coverage relationship between normal distribution and standard deviation.

FIG. 5 is a graph illustrating an area coverage relationship between normal distribution and the standard deviation (σ).

Preferably, a coefficient A of the standard deviation (σ) used for calculation of the representative smoothness (M) is three (three standard deviations) because at ±3σ, 99.73% of the normal distribution with the mean of the average smoothness (m) can be covered.

Figure 6:
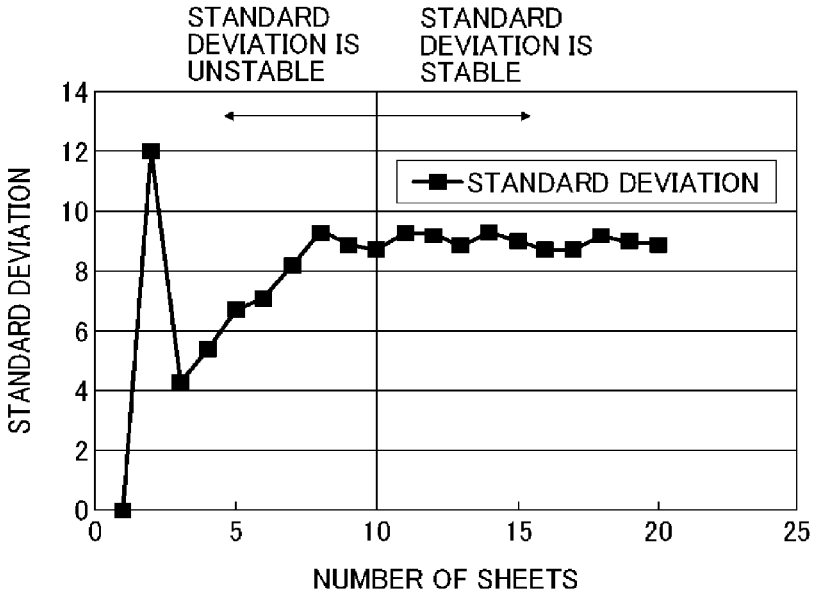
FIG. 6 is a graph illustrating fluctuated standard deviation with respect to the number of sheets.

FIG. 6 is a graph illustrating fluctuated standard deviation with respect to the number of sheets.

When a predetermined number B of sheets is conveyed, the fixing temperature is adjusted using an equation for calculating the representative smoothness (M). In this case, when eight sheets are conveyed, the fixing temperature may be adjusted because the standard deviation is stabilized as illustrated in FIG. 6. Preferably, however, the fixing temperature may be adjusted when ten sheets are conveyed, because a larger number of sheets are preferable for stability.

Figure 7:
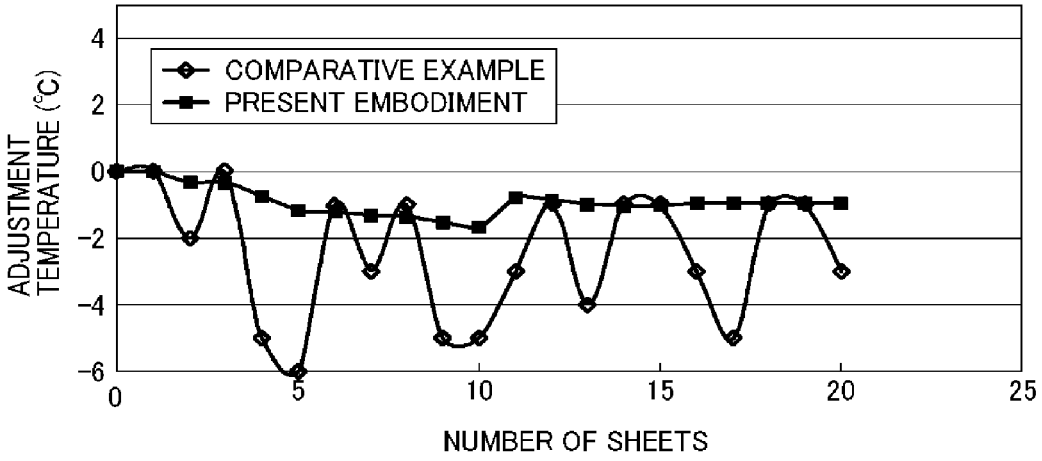
FIG. 7 is a graph comparing fluctuated adjustment temperature according to an embodiment of the present invention with fluctuated adjustment temperature according to a comparative example.

FIG. 7 is a graph comparing fluctuated adjustment temperature according to the present embodiment with fluctuated adjustment temperature according to a comparative example.

As illustrated in FIG. 7, according to the present embodiment, the adjustment temperature can be stabilized when the fixing temperature is adjusted based on the representative smoothness (M), compared to when the fixing temperature is not adjusted based on the representative smoothness (M) as in the comparative example.

Accordingly, an appropriate target fixing temperature can be determined taking into account the adjustment temperature and therefore a fixing operation can be performed with the target fixing temperature quickly and efficiently. Specifically, according to the smoothness of a recording sheet S detected, the target fixing temperature of the fixing device 60 is determined for the subsequent recording sheets S.

Figure 8:
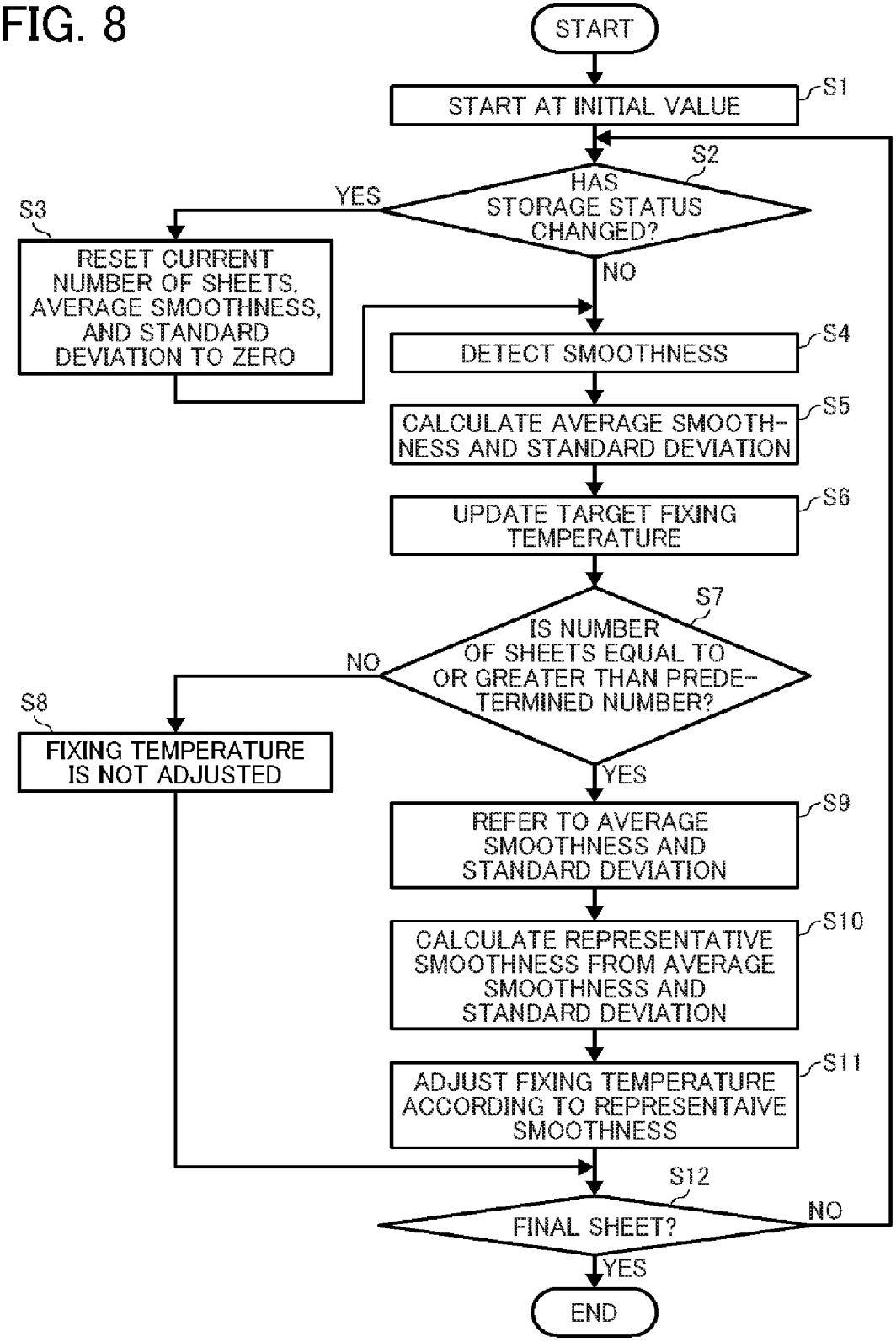
FIG. 8 is a flowchart of a fixing temperature adjustment process according to an embodiment of the present invention.

Referring now to FIG. 8, a detailed description is given of determination of the target fixing temperature according to the present embodiment. FIG. 8 is a flowchart of a fixing temperature adjustment process.

In step S1, the CPU 301 controls the heat-source control circuit 63 such that an image forming process is executed with a predetermined initial value, that is, a target fixing temperature determined based on the smoothness and thickness of a sheet of plain paper having an A4 size, typically used as a recording sheet S.

In step S2, the CPU 301 detects a storage status of the paper trays 11 and the bypass tray 430 accommodating recording sheets S, particularly one of those trays selected manually or automatically selected by the CPU 301.

In other words, the CPU 301 detects whether or not the smoothness of recording sheets S is changed because of, e.g., replacement of recording sheets S according to detection by the empty sensor or the draw sensors 16A and/or 16B. If the CPU 301 detects that the storage status is not changed, in other words, the recording sheets S are not replaced with new ones (NO in step S2), then the process proceeds to step S4. On the other hand, if the CPU 301 detects that the storage status is changed, in other words, the recording sheets S are not left or are replaced with new ones (YES in step S2), then the process proceeds to step S3.

In step S3, the CPU 301 resets respective values of current number of sheets, average smoothness (m), and standard deviation (σ) from past image forming processes, if any, to zero.

In step S4, the CPU 301 starts conveyance of a recording sheet S. The sensor 70 detects the smoothness of the recording sheet S while the registration device 80 registers the recording sheet S, for example, while the registration device 80 corrects the skew of the recording sheet S or adjusts the time to convey the recording sheet S for the secondary transfer.

In step S5, the CPU 301 calculates the average smoothness (m) based on the readings stored in the memory unit 302. In this case, if changes in the storage status are not detected and the readings stored in the memory unit 302 are not reset to the initial value in step S2, the recording sheet S is the first one subjected to image formation. However, the memory unit 302 stores readings from past image forming processes.

In step S5, the CPU 301 calculates the average smoothness (m) using the following equation and stores the average smoothness (m) thus obtained in the memory unit 302:

$$m = \frac{1}{N}\sum_{i=1}^{N} x_i$$

where "m" represents the average smoothness of the readings stored in the memory unit 302, "Xi" represents a reading (variable) stored in the memory unit 302, "N" represents the number of recording sheets S conveyed, and "σ" represents a standard deviation.

In step S5, the CPU 301 also calculates the standard deviation (σ) using the following dispersion equation and stores the standard deviation (σ) thus obtained in the memory unit 302:

$$\sigma^2 = \frac{1}{N}\sum_{i=1}^{N}(x_i - m)^2$$

In step S6, the CPU 301 controls the heat-source control circuit 63 to adjust the target fixing temperature using the average smoothness (m) or the standard deviation (σ).

If sheets of plain paper are used as recording sheets S, the average smoothness (m) does not significantly change because the smoothness is relatively high and the sensor 70 provides relatively stable readings. In such a case, the CPU 301 controls the heat-source control circuit 63 to adjust the target fixing temperature using the average smoothness (m) or its approximation value obtained by rounding down a value taking into account a margin of error.

By contrast, if the recording sheets S have a relatively rough surface and therefore relatively low smoothness, the average smoothness (m) varies significantly because the sensor 70 provides a range of different readings. When a wide range of different readings is provided in this manner, the target fixing temperature changes for each recording sheet S, resulting in unstable temperature control. In such a case, the CPU 301 controls the heat-source control circuit 63 to adjust the target fixing temperature using the standard deviation (σ) or its approximation value obtained by rounding down a value taking into account a margin of error.

In step S7, the CPU 301 determines whether or not the number of sheets (N) reaches the predetermined number B of sheets, for example, ten sheets.

If the CPU 301 determines that the number of sheets (N) does not reach the predetermined number B of sheets (NO in step S7), then the target fixing temperature is not adjusted in step S8. Then, the process proceeds to step S12 with the target fixing temperature updated in step S6.

On the other hand, if the CPU 301 determines that the number of sheets (N) reaches the predetermined number B of sheets (YES in step S7), then the CPU 301 refers to the average smoothness (m) and the standard deviation (σ) stored in the memory unit 302 (step S9). In step S10, the CPU 301 calculates a representative smoothness (M) using an equation of M=m−Aσ, where "M" represents the representative smoothness and "A" represents a rational number.

In step S11, the CPU 301 outputs an adjusted value according to the representative smoothness (M) to the controller 75. The controller 75 outputs a control signal of increasing or decreasing the adjusted value from the target fixing temperature to the heat-source control circuit 63 to control the heat-source control circuit 63. The CPU 301 repeats the above-described flow until the last image forming process is completed (YES in step S12).

As described above, when, e.g., sheets of plain paper having a relatively high and stable smoothness with little difference of surface roughness thereamong are used as the recording sheets S, the CPU 301 controls the heat-source control circuit 63 to adjust the target fixing temperature using the average smoothness (m) or its approximation value as a predicted value.

By contrast, when, e.g., the recording sheets S have a relatively rough surface and therefore relatively low smoothness, the CPU 301 controls the heat-source control circuit 63 to adjust the target fixing temperature using the standard deviation (σ) or its approximation value as a predicted value.

If the CPU 301 determines that the number of sheets (N) reaches the predetermined number B of sheets (e.g., 10 sheets), then the CPU 301 calculates the representative smoothness (M) with reference to the average smoothness (m) and the standard deviation (σ) stored in the memory unit 302, and increases or decreases the adjusted value obtained according to the representative smoothness (M) from the target fixing temperature.

In the present embodiment, the paper trays 11A and 11B as well as the bypass tray 430 are used. The recording sheets S accommodated in the paper trays 11A and 11B and the bypass tray 430 may be different in size and/or type.

Accordingly, the memory unit 302 stores the readings, average smoothness (m), the standard deviation (σ), and the representative smoothness (M) for each of the paper trays 11A and 11B and the bypass tray 430.

As described above, in the present embodiment, the average smoothness (m) and the standard deviation (σ) are used as predicted values for fixing temperature control for the next recording sheet S. The adjusted value obtained according to the representative smoothness (M) is used at a predetermined time.

However, if the relative positions (e.g., angle and distance) of the recording sheet S and the sensor 70 are not appropriate for optimal detection, the sensor 70 may provide a lower reading than the true value. If, according to such a lower reading, the target fixing temperature is controlled using the average smoothness (m) as a predicted value, the fixing temperature may be excessively increased, causing image failure and an increase in power consumption.

If it is deemed that the smoothness is not accurately detected, preferably, the predicted value is not used for fixing temperature control. In other words, preferably, the fixing temperature control may be performed with an initial value without using the smoothness of recording sheets. Accordingly, in the present embodiment, the detected smoothness values stored in the memory unit 302 are reset.

For example, the smoothness may not be accurately detected upon conveyance malfunction of the recording sheets S (e.g., jam, skew, and multi feeding). Generally, a jam is detected by a reflective or transmissive sensor. In the image forming apparatus 1, the jam sensor 17 detects a jam of the recording sheets S. The skew sensor 18 and the multi feed sensor 19 detect a skew and multi feeding of the recording sheets S, respectively. Detection of such conveyance malfunction indicates that conveyance of the recording sheets S has some problems. For example, humidity adjustment of recording sheets beyond capacity may cause unexpected curling, or recording sheets may be misplaced.

In such a case, the smoothness may not be accurately detected. Therefore, the detected smoothness values previously stored are reset, so that the fixing temperature control is performed with an initial value without using the smoothness of recording sheets.

Receiving an interrupt signal such as jam detection by the jam sensor 17, the CPU 301 executes a separate control process from the process of FIG. 8.

Figure 9:
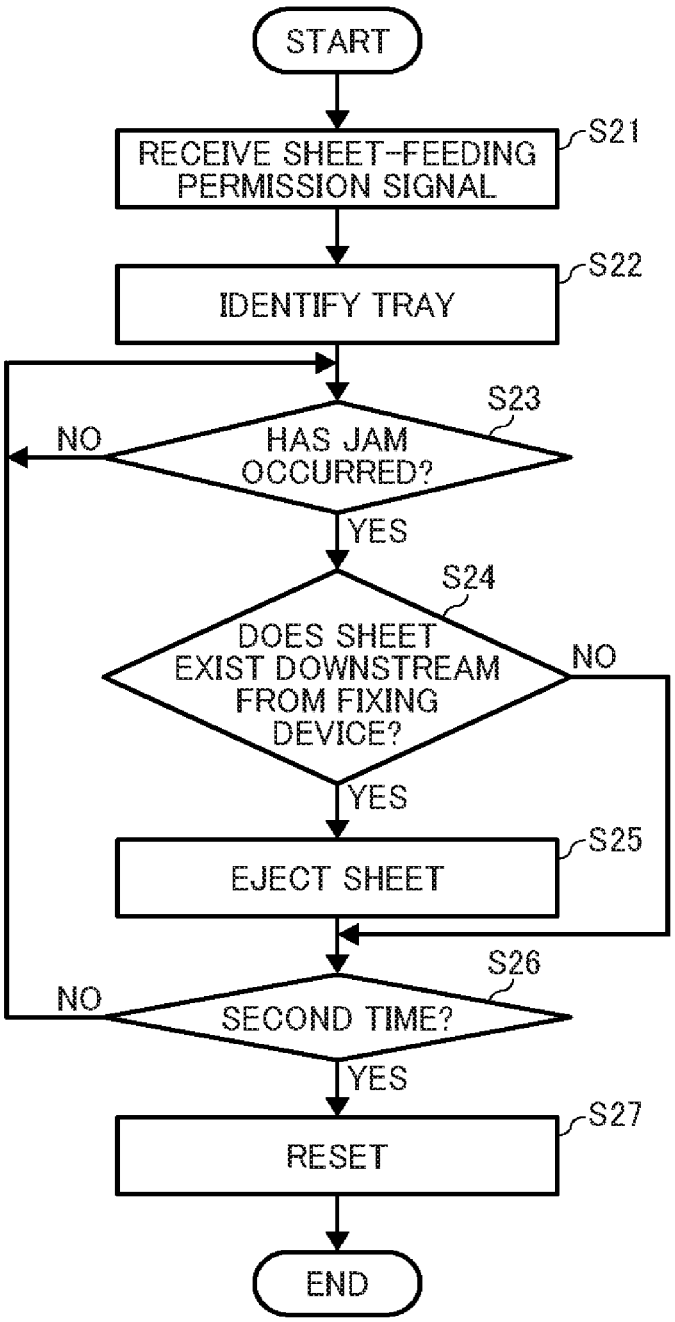
FIG. 9 is a flowchart of a predicted value reset process according to an embodiment of the present invention.

FIG. 9 is a flowchart of a predicted value reset process performed in the fixing device 60, as an example of such a control process executed by the CPU 301 when the interrupt signal is generated.

In step S21, when receiving a sheet-feeding permission signal, the CPU 301 starts an image forming operation according to image data. In the present embodiment, the beginning of the image forming operation is when the CPU 301 receives the sheet-feeding permission signal.

In the next step S22, according to sheet size data included in the image data and document size data detected in the document feeder 100, the CPU 301 identifies which tray to use, specifically, which recording sheet S to convey from the paper trays 11A, 11B, or the bypass tray 430. After selecting a recording sheet S suitable for the sheet size data and the document size data, the CPU 301 starts conveyance of the recording sheet S. Thus, the image forming process starts.

It is to be noted that the normal image forming process starts with the above-described flow. In other words, the above-described flow is not attributed to the interrupt signal. In step S23, when receiving any detection signal, the CPU 301 identifies whether or not the detection signal is an interrupt signal relative to a conveyance malfunction (hereinafter described as a jam) of the recording sheet S. If the CPU 301 determines that a jam has occurred (YES in step S23), the process proceeds to step S24. On the other hand, if the CPU 301 determines that no jam has occurred (NO in step S23), then the CPU 301 repeats the above-described process until the final sheet of the recording sheets S is ejected as illustrated in step S12 of FIG. 8 while continuing identification of the interrupt signal. In the present embodiment, the end of the image forming operation is when the final sheet of the recording sheets S is ejected.

In step S24, the CPU 301 determines whether or not a recording sheet S bearing a fixed image (but not being ejected) exists downstream from the fixing device 60. If the CPU 301 determines that a recording sheet S bearing a fixed image (but not being ejected) exists downstream from the fixing device 60 (YES in step S24), then the process proceeds to step S25. On the other hand, if the CPU 301 determines that a recording sheet S bearing a fixed image (but not being ejected) does not exist downstream from the fixing device 60 (NO in step S24), then the process proceeds to step S26. It is to be noted that the CPU 301 may determine whether or not a recording sheet S during a fixing operation exists upon the above-described determination. Alternatively, the CPU 301 may not count the recording sheet S during a fixing operation upon the above-described determination because the recording sheet S during the fixing operation may not bear a proper image due to fixing errors.

In step S25, the CPU 301 ejects the recording sheet S bearing a fixed image (but not being ejected). Then, the process proceeds to step S26. Thus, a reading described later is reset not upon detection of a jam, but after a previously conveyed recording sheet S passes through the fixing device 60 to prevent fixing errors due to significant temperature fluctuation, which may be caused when the reading is reset and the target fixing temperature is drastically changed.

It is to be noted that if the CPU 301 identifies the current jam as the first one, then the process returns to step S23 because a jam may occur unexpectedly. In such a case, a greater control loss may be generated if the readings stored in the memory unit 302 are reset to determine the target fixing temperature again. Therefore, the readings are not reset when only one jam occurs.

Thus, in step S26, the CPU 301 identifies whether or not the current jam is the second one in a series of image forming processes without replacement of recording sheets S or a current series of image forming processes. In short, the CPU 301 identifies whether the recording sheet S currently jammed is the same type as a recording sheet S1 previously jammed, and conveyed from the same tray as that from which the recording sheet S1 was conveyed. If the CPU 301 identifies that the current jam is not the second one but the first one (NO, in step S26), then the process returns to step S23. If the CPU 301 identifies that the current jam is the second one (YES, in step S26), then the process proceeds to step S27.

In step S27, according to the selection of a tray, specifically, according to the identification of which recording sheet S to convey from the paper trays 11A, 11B, or the bypass tray 430, the CPU 301 resets the detected smoothness values stored in the memory unit 302 for the selected tray. For example, if a jam occurs, the recording sheets S may be improperly accommodated in the paper trays 11A or 11B. If the jammed recording sheet S is conveyed from the paper tray 11B, the CPU 301 resets the detected smoothness values stored in the memory unit 302 for the paper tray 11B.

If it is unclear which tray the jammed recording sheet S is conveyed from in, e.g., mixed loading mode, the CPU 301 resets the detected smoothness values stored in the memory unit 302 for all the paper trays 11A and 11B and the bypass tray 430 to reduce risks to generate unacceptable images.

As described above, in the image forming apparatus 1, upon detection of a sign, that is, detection of an external factor that causes the sensor 70 to detect a range of different smoothnesses upon, e.g., improper conveyance of recording sheets S such as a jam, a skew, or multi feeding, the CPU 301 resets the detected smoothness values stored in the memory unit 302 for the paper trays 11A, 11B, and/or the bypass tray 430 that accommodates the recording sheets S, thereby preventing unstable adjustment of the target fixing temperature of the fixing device 60 in the event that the reliability of detected smoothness data of the recording sheets S cannot be maintained. It is to be noted that the image forming apparatus may be a copier, a facsimile machine, a printer or a multifunction peripheral having two or more of those capabilities.

The present invention has been described above with reference to specific exemplary embodiments. It is to be noted that the present invention is not limited to the details of the embodiments described above, but various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. An image forming apparatus comprising:

a first storage to store recording media;

a smoothness detector to detect surface smoothness of the recording media;

a memory device operatively connected to the smoothness detector to store smoothness values detected by the smoothness detector;

a transfer device to transfer a toner image onto a surface of each of the recording media;

a fixing device disposed downstream from the transfer device in a media conveyance direction to fix the toner image onto the surface of each of the recording media under heat and pressure;

a temperature controller operatively connected to the fixing device to determine a target fixing temperature of the fixing device for a second and subsequent recording media based on a predicted value calculated from the smoothness values stored in the memory device; and a processor to reset the smoothness values stored in the memory device in response to detection of an external factor that causes the smoothness detector to provide a smoothness value out of a predetermined range of the predicted value during an image forming operation from when the processor receives a sheet-feeding permission signal of one of the recording media stored in the first storage until the recording medium is ejected, wherein the smoothness detector is disposed downstream from the first storage in the media conveyance direction.

2. The image forming apparatus according to claim 1, further comprising a registration device to register conveyance of each of the recording media, wherein the smoothness detector is disposed upstream from the registration device in the media conveyance direction.

3. The image forming apparatus according to claim 1, wherein the smoothness detector is disposed upstream from the transfer device in the media conveyance direction.

4. The image forming apparatus according to claim 1, wherein the processor is configured to detect a conveyance malfunction of the recording media.

5. The image forming apparatus according to claim 4, further comprising a second storage to store recording media, wherein the processor sets a predicted value for each of the first storage and the second storage, and resets the predicted value set for one of the first storage and the second storage from which a recording medium is conveyed, upon identifying the one of the first storage and the second storage as a source of the conveyance malfunction.

6. The image forming apparatus according to claim 4, further comprising a second storage to store recording media, wherein the processor sets a predicted value for each of the first storage and the second storage, and resets the predicted value set for each of the first storage and the second storage in response to detection of a conveyance malfunction.

7. The image forming apparatus according to claim 4, wherein the processor resets the smoothness values stored in the memory device after a recording medium downstream from the fixing device passes through the fixing device.

8. The image forming apparatus according to claim 4, wherein the processor resets the smoothness values stored in the memory device in response to detection of a plurality of conveyance malfunctions.

9. The image forming apparatus according to claim 1, wherein the processor resets the smoothness values stored in the memory device after a recording medium downstream from the fixing device passes through the fixing device.

10. The image forming apparatus according to claim 1, wherein the processor resets the smoothness values stored in the memory device in response to detection of a plurality of conveyance malfunctions.

* * * * *